US007766081B2

(12) United States Patent
Brown et al.

(10) Patent No.: US 7,766,081 B2
(45) Date of Patent: Aug. 3, 2010

(54) GAS SEPARATOR WITHIN ESP SHROUD

(75) Inventors: Donn J. Brown, Broken Arrow, OK (US); Brown Lyle Wilson, Tulsa, OK (US); Gary L. James, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 117 days.

(21) Appl. No.: 11/852,865

(22) Filed: Sep. 10, 2007

(65) Prior Publication Data

US 2009/0065202 A1 Mar. 12, 2009

(51) Int. Cl.
*E21B 43/38* (2006.01)
*B01D 19/00* (2006.01)

(52) U.S. Cl. ..... 166/105.5; 166/265; 95/261; 96/217

(58) Field of Classification Search ..... 166/105.5, 166/265; 95/261; 96/217
See application file for complete search history.

(56) References Cited

U.S. PATENT DOCUMENTS

| | | | | |
|---|---|---|---|---|
| 3,624,822 | A * | 11/1971 | Carle et al. | 417/313 |
| 4,330,306 | A * | 5/1982 | Salant | 96/219 |
| 6,190,141 | B1 * | 2/2001 | Henry | 417/423.3 |
| 6,668,925 | B2 | 12/2003 | Shaw et al. | |
| 6,691,782 | B2 | 2/2004 | Vandevier | |
| 6,702,027 | B2 | 3/2004 | Olson et al. | |
| 6,736,880 | B2 * | 5/2004 | Ford et al. | 95/248 |
| 7,051,815 | B2 | 5/2006 | Ireland et al. | |
| 7,150,325 | B2 | 12/2006 | Ireland et al. | |

* cited by examiner

*Primary Examiner*—Giovanna C Wright
(74) *Attorney, Agent, or Firm*—Bracewell & Giuliani LLP

(57) ABSTRACT

A submersible well pump assembly has a gas separator that separates gas prior to entering into the pump. A shroud encloses a portion of the pump assembly, including the gas separator. The gas separator has gas discharge tubes that extend from it out through the shroud. The gas discharge tubes are tangentially aligned to create a vortex on the exterior of the shroud.

20 Claims, 3 Drawing Sheets

GAS SEPARATOR WITHIN ESP SHROUD

FIELD OF THE INVENTION

This invention relates in general to electrical submersible well pumps, and in particular to a submersible pump assembly enclosed by a shroud and having a gas separator therein that discharges gas tangentially from the shroud to initiate a vortex in the casing.

BACKGROUND OF THE INVENTION

An electrical submersible pump assembly (ESP) for a well typically includes a centrifugal pump driven by a submersible electrical motor. The ESP is normally installed within the well on tubing. Many wells produce a combination of oil and water as well as some gas. Centrifugal pumps are mainly designed to handle liquid and will suffer from head degradation and gas locking in the presence of a high percentages of free gas. Several techniques have been developed to remove the gas before it enters the pump.

One technique relies on causing the well fluid to flow downward before reaching the pump intake to cause separation of gas. Gas bubbles within the well fluid flow tend continue flowing upward as a result of the buoyant force of the gas bubbles. The downward flowing liquid in the well fluid creates an opposing drag force that acts against the upward moving bubbles. If the upward buoyant force is greater than the downward drag force, the bubbles will break free of the downward flowing well fluid and continue moving upward. Buoyancy is a function of the volume of the bubble, and the drag force is a function of the area of the bubble. As the diameter of the bubble increases, the buoyant force will become larger than the drag force, enabling the bubble to more easily separate from the liquid and flow upward. Consequently, if the bubbles can coalesce into larger bubbles, rather than dispersing into smaller bubbles, the separating efficiency would be greater.

A shroud may be mounted around the portions of the ESP to cause a downward flow of well fluid. In one arrangement, the upper end of the shroud is sealed to the ESP above the intake of the pump, and the lower end of the shroud is open. The perforations in the casing are located above the open lower end of the shroud in this arrangement. The well fluid will flow downward from the perforations past the shroud and change directions to flow back up into the shroud, around the motor and into the pump intake. Some gas separation may occur as the well fluid exits the perforations and begins flowing downward.

In an inverted type of shroud, the shroud is sealed to the ESP below the pump intake and above the motor, which extends below the shroud. The inlet of the shroud is at the upper end of the shroud above the pump. The perforations in the casing are below the motor, causing well fluid to flow upward past the motor and shroud and back downward into the open upper end of the shroud. Passive gas separation occurs as the well fluid changes direction to flow downward into the shroud.

Another technique employs a gas separator mounted in the submersible pump assembly between the motor seal section and the pump entrance. The gas separator has an intake for pulling fluids in and a rotating vane component that centrifugally separates the gas from the liquid. The liquid is then directed to the entrance of the pump, and the gas is expelled back into the annulus of the casing. The gas separator provides a well fluid to the pump with a gas content low enough so that it does not degrade the pump performance. The quality of the fluid discharged back into the casing is normally of little concern. In fact, it may have a roughly high liquid content, but the liquid will return back downward to the gas separator intake while the gas would tend to migrate upward in the casing.

Normally, a gas separator would not be incorporated with a shrouded ESP because of the problem of disposing of the gas into the well fluid flowing toward the inlet of the shroud. Gas being discharged into flowing well fluid tends to break up into smaller bubbles and become entrained in the flow. If the shroud inlet is on the lower end, any gas discharged from the gas separator into the shroud annulus would be entrained in the downward flowing fluid and re-enter the inlet. If the shroud inlet is on the upper end, any gas discharged from the gas separator would flow upward through the annulus surrounding the shroud and might fail to separate from the liquid at the inlet of the shroud where the well fluid begins flowing downward.

SUMMARY OF THE INVENTION

In this invention, a gas separator is mounted to the ESP. A shroud encloses at least a portion of the ESP and the gas separator. The gas separator has a passage that extends from its gas outlet through the shroud for discharging the lighter components exterior of the shroud. Preferably the passage is substantially tangent to an outer diameter portion of the shroud at the gas outlet. Making the passage tangent enhances the formation of a vortex as the gas discharges. The vortex increases the passive separation of the fluids by continuing to cause coalescing of bubbles in the fluid as it exits.

DETAILED DESCRIPTION OF THE INVENTION

Figure 1:
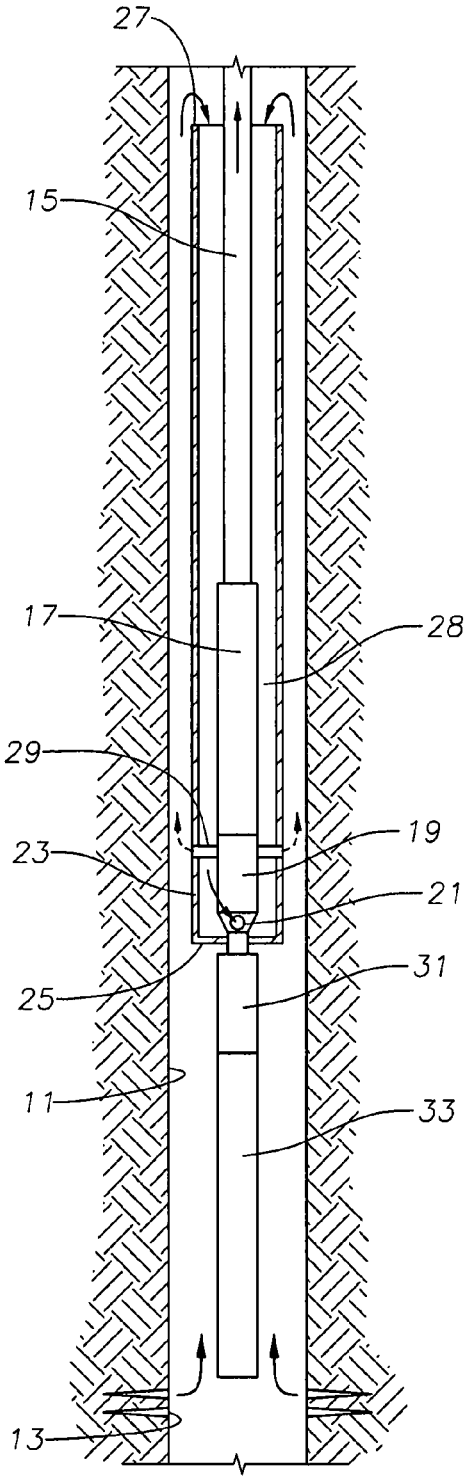
FIG. 1 is a schematic sectional view illustrating a first embodiment of an apparatus for producing well fluid in accordance with this invention.

Referring to FIG. 1, cased borehole 11 illustrates a typical well having an inlet comprising perforations 13 for the flow of well fluid containing gas and liquid into cased borehole 11. A string of tubing 15 extends downward from the surface for supporting a rotary pump 17. Pump 17 is illustrated as being a centrifugal pump, which is one having a large number of stages, each stage having an impeller and a diffuser. Pump 17 could be other types of rotary pumps, such as a progressing cavity pump. A gas separator 19 is connected to the lower end of pump 17. Gas separator 19 is preferably an active type, as will be described subsequently. Gas separator 19 has an intake 21 through which all of the well fluid enters prior to reaching pump 17.

A shroud 23 is mounted in an inverted manner in the embodiment of FIG. 1. Shroud 23 has a closed lower end 25 that is secured sealingly around the pump assembly a short distance below gas separator intake 21. Shroud 23 has an open upper end 27 that is located above the upper end of pump 17 in this example. The length of shroud 23 depends upon the content of gas in the well fluid, and it could be several hundred feet long. The inner diameter of shroud 23 is larger than the outer diameter of gas separator 19 in this embodiment, creating a shroud annulus 28 between them.

Gas separator 19 has at least one gas discharge tube 29, and preferably more than one. Each gas discharge tube 29 extends from the outer diameter of gas separator 19 through shroud annulus 28 and out of shroud 23 for discharging separated gas into the casing annulus surrounding shroud 23.

A seal section 31 secures to the lower end of gas separator 19. A motor 33, normally an electrical three-phase motor, secures to the lower end of seal section 31. Seal section 31 has means within it for equalizing the pressure of the lubricant contained in motor 33 with the well fluid on the exterior of motor 33. Motor 33 and seal section 31 are not located within shroud 23 in this embodiment, and the lower end of motor 33 is preferably located above perforations 13.

Figure 3:
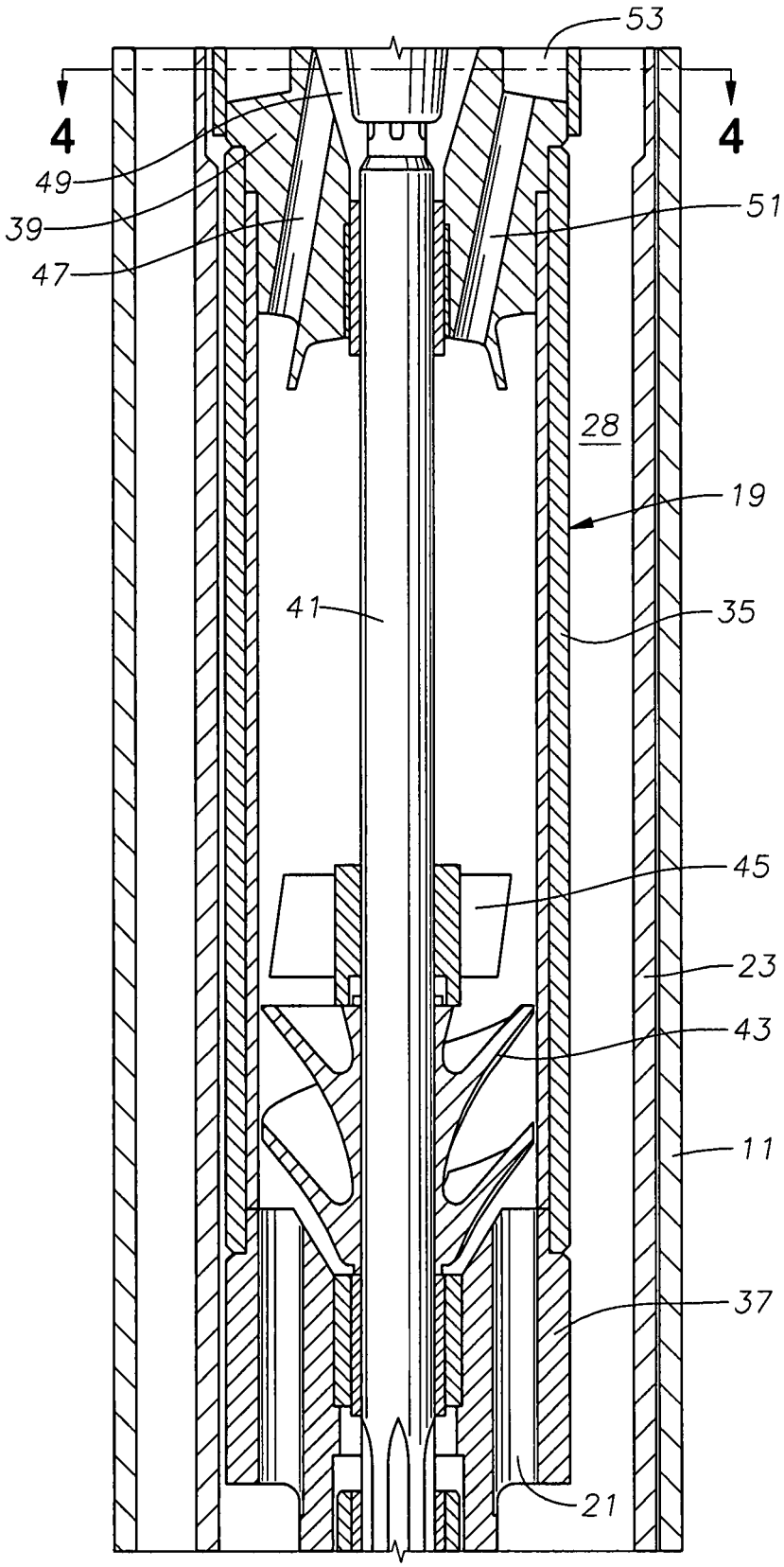
FIG. 3 is an enlarged sectional view of a portion of the gas separator of the pump assembly shown in FIGS. 1 and 2.

FIG. 3 illustrates one type of a gas separator, but gas separator 19 could be different types. For example, shroud 23 is shown eccentric with respect to cased borehole 11 in order to accommodate a power cable (not shown) on the exterior of shroud 23 leading to motor 33 (FIG. 1). To keep gas separator 19 centered in cased borehole 11, it is located eccentric with respect to shroud 23. Alternately, by routing the power cable within shroud 23, shroud 23 could be concentric to cased borehole 11, and gas separator 19 concentric to shroud 23.

Gas separator 19 has a housing 35 that is cylindrical. An intake member 37 is located at and forms the lower end of housing 35. A cross-over member 39 is located at and forms the upper end of housing 35. A rotatably driven shaft 41 extends through intake member 37, housing 35 and cross-over member 39. Shaft 41 is coupled to the shaft (not shown) of seal section 31 (FIG. 1), which in turn is coupled for rotation to the shaft of motor 33. A type of inducer referred to as a high angle auger 43 is mounted to shaft 41 for rotation therewith. Auger 43 draws well fluid in through intake 21 in intake member 37, and pumps it upward. Auger 43 could be eliminated or replaced with another type of inducer. A plurality of vanes 45 are mounted to shaft 41 above auger 43 for imparting centrifugal force to the well fluid. The centrifugal force forces heavier well fluid components out toward housing 35 while the lighter components remain in a central area surrounding shaft 41. A rotating drum with radial flat vanes could alternately be substituted for or used in combination with vanes 45.

Cross-over member 39 has a plurality of liquid passages 47. Each liquid passage 47 has a lower end radially outward near housing 35 and an upper end that is radially inward from the lower end for discharging the heavier components into a central chamber 49. Central chamber 49 leads to the entrance of pump 17 (FIG. 1). Cross-over member 39 also has a plurality of gas passages 51. Each gas passage 51 has a radially inward lower end near shaft 41 and an upper end that is radially farther outward from shaft 41 than the lower end. Gas passages 51 discharge the lighter components into an annular chamber 53. Cross-over member 39 is illustrated as being a non-rotating type, but a rotating cross-over member could be used instead.

Figure 4:
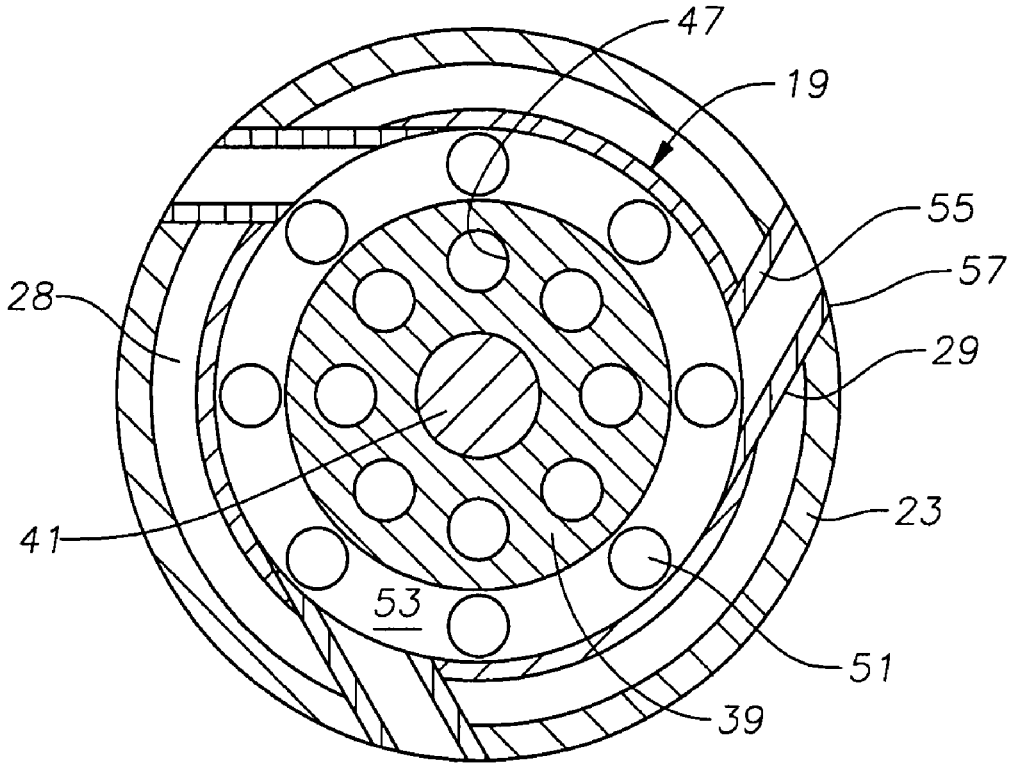
FIG. 4 is a transverse sectional view of the gas separator and the shroud of FIG. 3, taken along the line 4-4 of FIG. 3.

Referring to FIG. 4, each gas tube 29 has an inner end that joins annular chamber 53 and an outer end that extends to a gas outlet port 57 in shroud 23. Each gas tube 29 is located within shroud annulus 28 between the exterior of gas separator 19 and the inner diameter of shroud 23. As shown in FIG. 4, in this example, there are three tubes 29 spaced 120 degrees apart from each other. The number of tubes 29 can vary. The open spaces between tubes 29 in shroud annulus 28 provide flow paths for well fluid to flow past tubes 29 within shroud annulus 28 as the well fluid flows downward to intake 21 (FIG. 1). Each tube 29 has a passage 55 within it that is substantially located on a line that is tangent to the outer diameter of annular chamber 53. The gas being discharged from chamber 53 thus moves outward through shroud 23 generally on a tangent line of gas separator housing 35 (FIG. 3) to create a vortex surrounding shroud 23. The tangentially discharged gas tends to coalesce and avoid remixing with well fluid flowing upward from perforations 13 (FIG. 1).

Rather than separate gas discharge tubes 29, an annular member with multiple gas passages 55 formed in it could be located in shroud annulus 28 between gas separator 19 and shroud 23. Vertical passages could be formed in the annular member for fluid to flow downward in shroud annulus 28 to intake 21.

In the operation of the embodiment illustrated by FIG. 1, the well fluid flows from perforations 13 upward past motor 33 and through a casing annulus surrounding shroud 23. At the upper end of shroud 23, the well fluid flow changes direction to flow down shroud inlet 27 into shroud annulus 28. When changing direction, some of the gas bubbles in the well fluid, particularly the larger volume gas bubbles, will continue flowing upward in cased borehole 11 for collection at the surface. The well fluid flowing downward in shroud 23 normally also contains some gas that failed to passively separate as the well fluid began flowing downward. The well fluid, along with some gas, enters gas separator intake 21, which is near the lower end of shroud 23.

Gas separator 19 is driven by motor 33 to apply centrifugal force to the well fluid. This results in the liquid or heavier components flowing from gas separator 19 into pump 17 while the lighter components flow out gas discharge tubes 29 into the casing annulus surrounding shroud 23. The gas exiting gas discharge tubes 29 re-enters the casing annulus where well fluid is flowing upward from perforations 13. The tangential arrangement of gas discharge tubes 29 creates a vortex of the lighter components as they discharge into the annulus surrounding shroud 23. The vortex enhances coalescence and reduces the amount of the gas re-entering the open upper end of shroud 23.

Figure 2:
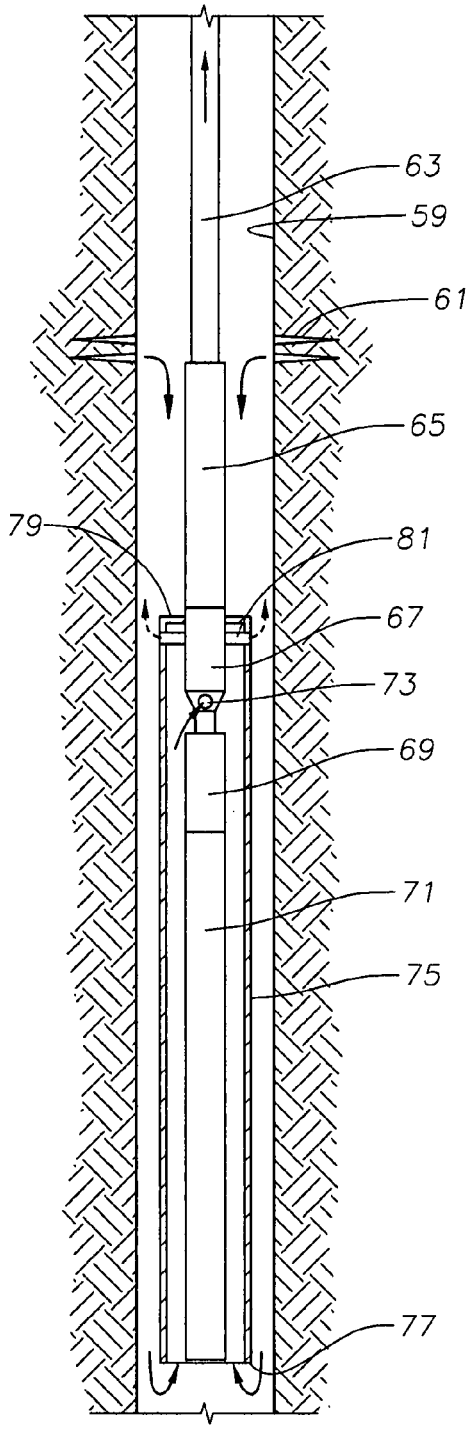
FIG. 2 is a schematic sectional view of a second embodiment of an apparatus for producing a well fluid.

In the alternate embodiment of FIG. 2, cased borehole 59 is also a well having a set of perforations 61 for receiving a flow that is a mixture of liquid and gas. A string of tubing 63 supports an ESP that includes a centrifugal pump 65. A gas separator 67, which may be the same as shown in FIG. 3, is mounted to the lower end of pump 65. A seal section 69 connects to the lower end of gas separator 67. An electrical motor 71 is mounted to the lower end of seal section 69. Gas separator 67 has an intake 73 that receives all well fluid flowing downward from perforations 61, which are located above gas separator intake 73.

A shroud 75 is mounted over a portion of the pump assembly. In this embodiment, shroud 75 has an open end 77 that is located below intake 73. Preferably, shroud 75 fully encloses motor 71 so that well fluid flowing in the open lower end 77 will flow upward past motor 71 for cooling. Shroud 75 has a closed upper end 79 that is located above intake 73. Closed upper end 79 need be located only a short distance above intake 73, but it could be located higher if desired, even above pump 65. Gas discharge tubes 81 are mounted between the gas outlet of separator 67 and ports in shroud 75. Gas discharge tubes 81 are tangentially oriented as in FIG. 4 and extend across the shroud annulus just below sealed end 79 in this example.

In the operation of the embodiment of FIG. 2, well fluid flows downward from perforations 61, and some gas will separate from the well fluid at perforations 61 due to the buoyant force. The well fluid flows down the casing annulus surrounding shroud 75 and into shroud open lower end 77.

The well fluid flows up the interior of shroud 75 into intake 73. Gas separator 67 is driven by motor 71 as in the first embodiment. Gas separator 67 delivers the heavier components to pump 65 for pumping to the surface. Gas separator 67 discharges the lighter components out discharge tubes 81. As the lighter components are discharged, they create a swirling vortex in the downward flowing well fluid from perforations 61. The vortex increases coalescence of the gas bubbles, thereby increasing the buoyancy and causing them to migrate upward rather than joining the downward flowing well fluid due to drag forces.

The invention has significant advantages. Mounting a gas separator within a shroud and discharging the gaseous components exterior of the shroud has an advantage of further removing gas before entering the pump. The tangential path of the discharge gas creates a vortex that causes coalescence of the bubbles so as to make the bubbles more buoyant. The larger volume bubbles are less susceptible to drag forces imposed by downward flowing well fluid. The gas separator and tangential gas tubes can be incorporated with an inverted shroud or a conventional shroud with its lower end located below the intake.

While the invention has been shown in only two of its forms, it should be apparent to those skilled in the art that it is not so limited but it is susceptible to various changes without departing from the scope of the invention. For example, the embodiment of FIG. 2 could also be employed within a caisson for boosting well fluid from the sea floor to a floating production facility. If a caisson, the inlet would be at the upper end of the caisson rather than at perforations located downward within the well.

The invention claimed is:

1. An apparatus for pumping a well fluid containing a mixture of liquid and gas, comprising:

an electrical submersible pump assembly having first and second components, one of the components being a rotary pump and the other a motor;

a gas separator mounted to the pump, the gas separator having an intake for receiving well fluid, the gas separator having a liquid discharge for delivering heavier components of the well fluid to the pump, the gas separator having a gas outlet for discharging lighter components of the well fluid;

a shroud surrounding the gas separator and the first component, defining an annulus between the gas separator and the shroud and between the first component and the shroud, the shroud having an open end into which well fluid flows before reaching the intake and a closed end; and a gas passage extending from the gas outlet through the shroud for discharging the lighter components exterior of the shroud, the gas passage having an exit nearer the closed end of the shroud than the open end.

2. The apparatus according to claim 1, wherein the passage is substantially tangent to an outer diameter portion of the gas separator at the gas outlet.

3. The apparatus according to claim 1, wherein the passage is located within a tube that extends through the annulus from an exterior portion of the gas separator to an inner diameter portion of the shroud.

4. The apparatus according to claim 1, wherein the gas separator comprises:

a housing;

a rotatably driven inducer in the housing for drawing well fluid into the intake;

a rotatably driven vane downstream from the inducer in the housing for applying centrifugal force to the well fluid;

a cross-over member above the vane in the housing, the cross-over member having a heavier component passage leading upward and inward for delivery to the pump, the cross-over member having a lighter component passage leading upward and outward to the gas outlet; and the exit of the gas passage is spaced from the open end of the shroud a distance greater than a length of the separator.

5. The apparatus according to claim 1, wherein the first component comprises the pump, the open end of the shroud is above the intake of the gas separator, and the exit of the gas passage is located below the open end of the shroud.

6. The apparatus according to claim 1, wherein the open end of the shroud is below the intake of the gas separator.

7. The apparatus according to claim 1, wherein the first component comprises the pump, and the open end of the shroud is above the pump and above the exit of the gas passage.

8. The apparatus according to claim 1, wherein the shroud encloses the motor, and the open end of the shroud is below the motor and below the intake of the gas separator.

9. An apparatus for pumping a well fluid containing a mixture of liquid and gas, comprising:

a cased borehole having an inlet for receiving well fluid;

a submersible pump assembly suspended within the cased borehole on a string of tubing, the tubing defining a casing annulus within the cased borehole, the pump assembly having first and second components, one of the components being a rotary pump and the other of the components being a motor that drives the rotary pump;

a gas separator incorporated within the assembly and having a vane rotated by the motor for separating lighter components of the well fluid from heavier components, the gas separator having an intake for receiving well fluid, the gas separator having a liquid discharge for delivering the heavier components to the pump, the gas separator having at least one gas outlet above the intake for discharging the lighter components;

a shroud surrounding the gas separator and the first component, defining a shroud annulus between the gas separator and the shroud and between the first component and the shroud, the shroud extending past the first component and having an open end into which well fluid from the inlet flows around the first component in the shroud annulus before reaching the intake; and a tube extending from said at least one gas outlet across the shroud annulus and to a port within the shroud for discharging the lighter components into the casing annulus exterior of the shroud, the tube being substantially on a tangent line of an outer diameter of the gas separator at said at least one gas outlet.

10. The apparatus according to claim 9, wherein:

the first component comprises the pump; and the open end of the shroud is above the pump and the intake of the gas separator;

the motor extends below a lower end of the shroud; and the inlet of the cased borehole is below the motor.

11. The apparatus according to claim 9, wherein:

the intake of the gas separator is below the inlet of the cased borehole; and the shroud also encloses the motor, and the open end of the shroud is below the motor and below the intake of the gas separator.

12. An apparatus for pumping a well fluid containing a mixture of liquid and gas, comprising:

a cased borehole having an inlet for receiving well fluid;

a submersible pump assembly suspended within the cased borehole on a string of tubing that extends out of the borehole, the tubing defining a casing annulus within the cased borehole, the pump assembly having a motor that drives a rotary pump;

a gas separator incorporated within the assembly and having a vane rotated by the motor, the gas separator having a well fluid intake, a liquid discharge, and at least one gas outlet above the intake;

a shroud enclosing at least portions of the assembly including the intake, the gas outlet, and the pump, defining a shroud annulus between the gas outlet of the gas separator and the shroud, the shroud having an open end above the pump into which well fluid from the inlet flows before reaching the intake; and a gas discharge member extending from said at least one gas outlet across the shroud annulus and to a port within the shroud, the gas discharge member having a gas passage therein for discharging the lighter components flowing out of the outlet into the casing annulus exterior of the shroud, the gas discharge member defining at least one well fluid flow path within the shroud annulus for well fluid to flow downward past the gas discharge member to the intake.

13. The apparatus according to claim 12, wherein:

the motor extends downward from a lower end of the shroud; and the inlet to the cased borehole is located below the motor.

14. The apparatus according to claim 12, wherein:

the gas discharge member comprises a tube.

15. The apparatus according to claim 12, wherein:

the passage within the gas discharge member is located on a line substantially tangent to an outer diameter of the gas separator at the gas outlet.

16. A method for pumping a well fluid from a cased borehole containing a mixture of liquid and gas, comprising:

(a) mounting a gas separator to a submersible pump assembly having first and second components, one of the components being a rotary pump and the other a motor that drives the pump, enclosing at least a portion of the gas separator and the first component within a shroud, and connecting a gas discharge member between a gas outlet of the separator and a port provided in the shroud;

(b) suspending the gas separator, the first and second components and the shroud on a string of tubing in a cased borehole;

(c) flowing a well fluid stream from an inlet into the cased borehole;

(d) operating the pump, causing the well fluid stream to flow into an open end of the shroud and past the first component to an intake of the gas separator;

(e) with the gas separator, separating heavier components of the well fluid stream from lighter components;

(f) flowing the heavier components from the gas separator into the pump and pumping the heavier components up the tubing; and (g) flowing the lighter components from the gas outlet of the separator through the gas discharge member and out a port in the shroud, the port being spaced so that the lighter components flow into the well fluid stream before the well fluid stream reaches the open end of the shroud.

17. The method according to claim 16, wherein step (g) comprises flowing the lighter components along a passage through the gas discharge member that is substantially on a line tangent to an outer diameter of the gas separator at the gas outlet.

18. The method according to claim 16, wherein step (d) comprises flowing the well fluid stream within the shroud past the gas discharge member.

19. The method according to claim 16, wherein:

steps (a) and (b) comprise positioning the open end of the shroud below the intake; and step (c) comprises flowing the well fluid downward from the inlet past the shroud, then back upward into the shroud.

20. A method for pumping a well fluid from a cased borehole containing a mixture of liquid and gas, comprising:

(a) mounting a gas separator to a submersible pump assembly having first and second components, one of the components being a rotary and the other a motor that drives the pump, enclosing at least a portion of the gas separator and the first component within a shroud, and connecting a gas discharge member between a gas outlet of the separator and a port provided in the shroud;

(b) suspending the gas separator, the first and second components and the shroud on a string of tubing in a eased borehole;

(c) flowing a well fluid stream from an inlet into the cased borehole;

(d) operating the pump, causing the well fluid stream to flow into an open end of the shroud and past the first component to an intake of the gas separator;

(e) with the gas separator, separating heavier components of the well fluid stream from lighter components;

(f) flowing the heavier components from the gas separator into the pump and pumping the heavier components up the tubing;

(g) flowing the lighter components from the gas outlet of the separator through the gas discharge member and out of the shroud; wherein:

steps (a) and (b) comprise positioning the open end of the shroud above the intake;

and step (c) comprises flowing the well fluid upward from the inlet past the shroud, then back downward into the shroud.

* * * * *

UNITED STATES PATENT AND TRADEMARK OFFICE

CERTIFICATE OF CORRECTION

PATENT NO. : 7,766,081 B2
APPLICATION NO. : 11/852865
DATED : August 3, 2010
INVENTOR(S) : Donn J. Brown et al.

It is certified that error appears in the above-identified patent and that said Letters Patent is hereby corrected as shown below:

Column 8, line 27, insert --pump-- after "rotary"

Signed and Sealed this

Thirtieth Day of November, 2010

David J. Kappos

David J. Kappos
*Director of the United States Patent and Trademark Office*